US010744537B2

(12) United States Patent
Fujita

(10) Patent No.: US 10,744,537 B2
(45) Date of Patent: Aug. 18, 2020

(54) CLEANING TOOL ATTACHMENT

(71) Applicant: SUGINO MACHINE LIMITED, Jozu, Toyama Prefecture (JP)

(72) Inventor: Shun Fujita, Takaoka (JP)

(73) Assignee: SUGINO MACHINE LIMITED, Uozu, Toyama Prefecture (JP)

( * ) Notice: Subject to any disclaimer, the term of this patent is extended or adjusted under 35 U.S.C. 154(b) by 243 days.

(21) Appl. No.: 15/232,918

(22) Filed: Aug. 10, 2016

(65) Prior Publication Data

US 2017/0156557 A1 Jun. 8, 2017

(30) Foreign Application Priority Data

Dec. 7, 2015 (JP) ..... 2015-238189

(51) Int. Cl.

| | |
|---|---|
| ***B08B 3/02*** | (2006.01) |
| ***B08B 1/04*** | (2006.01) |
| ***B05B 13/04*** | (2006.01) |
| ***B05B 3/02*** | (2006.01) |
| *B05B 1/14* | (2006.01) |

(52) U.S. Cl.

CPC ..... *B08B 3/02* (2013.01); *B05B 3/02* (2013.01); *B05B 13/0421* (2013.01); *B08B 1/04* (2013.01); *B05B 1/14* (2013.01)

(58) Field of Classification Search

CPC ..... B05B 13/0421; B08B 1/04; B08B 3/02; B23P 17/00; B23Q 11/00; A47L 9/0027

USPC ..... 15/300.1; 239/227

See application file for complete search history.

(56) References Cited

U.S. PATENT DOCUMENTS 4,338,036 A * 7/1982 DeLeu ..... F16D 1/096 403/16
4,702,124 A * 10/1987 Schleicher ..... B05B 13/0421 475/6
4,989,785 A * 2/1991 Walendowski ..... B05B 13/0421 118/323

FOREIGN PATENT DOCUMENTS

| | | | |
|---|---|---|---|
| DE | 102010013364 | A1 | 10/2011 |
| GB | 2261814 | A | 6/1993 |
| JP | 09-279842 | A | 10/1997 |
| JP | 10-057794 | A | 3/1998 |

(Continued)

OTHER PUBLICATIONS

Extended European Search Report dated Apr. 21, 2017 in the corresponding European patent application No. 16183152.4.

(Continued)

*Primary Examiner* — Mark Spisich
*Assistant Examiner* — Katina N. Henson
(74) *Attorney, Agent, or Firm* — United IP Counselors, LLC

(57) ABSTRACT

A cleaning tool attachment reduces the amount of foreign matter or cleaning liquid remaining on a workpiece. The cleaning tool attachment includes a housing, a first shaft integrally connectable to a main spindle, a second shaft having an axial direction different from an axial direction of the first shaft, a plurality of tool mounting shafts having an axial direction parallel to the axial direction of the second shaft, a rotation axis conversion gear mechanism arranged in the housing, and a synchronous rotation mechanism arranged in the housing. The synchronous rotation mechanism transmits a driving force of the second shaft to the plurality of tool mounting shafts, and rotates the plurality of tool mounting shafts at the same rotational speed and with synchronous phase angles.

20 Claims, 7 Drawing Sheets

(56) References Cited

FOREIGN PATENT DOCUMENTS

| | | | | |
|---|---|---|---|---|
| JP | 2000-084787 | A | | 3/2000 |
| JP | 2000-301079 | A | | 10/2000 |
| JP | 2011-230118 | A | | 11/2011 |
| JP | 2013-013984 | A | | 1/2013 |
| JP | 2013013984 | A | * | 1/2013 |
| JP | 5432943 | B | | 3/2014 |

OTHER PUBLICATIONS

"Multipurpose Highly Efficient Washing System," Sugino Machine Limited, May 2015, Tokyo, Japan, p. 7.
Office Action dated Nov. 13, 2018 in a corresponding Japanese Patent Application No. 2015-238189, 4 pp.

* cited by examiner

CLEANING TOOL ATTACHMENT

CROSS-REFERENCE TO RELATED APPLICATIONS

This application claims the benefit of priority to Japanese Patent Application No. 2015-238189, filed on Dec. 7, 2015, the entire contents of which are hereby incorporated by reference.

BACKGROUND

1. Technical Field

The present invention relates to a cleaning tool attachment.

2. Description of the Background

A turret type high-pressure cleaning device known in the art can remove burrs or chips on a workpiece by jetting a high-pressure cleaning liquid from a rotational nozzle onto the workpiece (e.g., Japanese Patent No. 5432943, hereafter referred to as Patent Literature 1). A turret type high-pressure cleaning device is mainly used in a final process after machining to clean a workpiece with a rotational nozzle or a deburring tool selectable from a variety of options in accordance with the shape of a cleaning target area.

After high-pressure cleaning with a rotational nozzle or deburring, the turret type high-pressure cleaning device removes the residual cleaning liquid on the workpiece by blowing air.

The high-pressure cleaning device may clean a plurality of workpieces or cleaning target areas with a plurality of cleaning tools. The workpieces are aligned in the same direction on a table, and are cleaned with a multiple nozzle or a twin nozzle including a plurality of rotational nozzles. The multiple nozzle or the twin nozzle is mounted on a turret, and attached to a main spindle (refer to, for example, page 7 of Multipurpose Highly Efficient Washing System, Sugino Machine Limited).

BRIEF SUMMARY

Some workpiece shapes may allow burrs, chips, or cleaning liquid to remain easily in their internal recesses, which are difficult to remove.

One or more aspects of the present invention are directed to a cleaning tool attachment that reduces the amount of foreign matter or cleaning liquid remaining on a workpiece.

A cleaning tool attachment for mounting a plurality of cleaning tools onto a main spindle of a cleaning device, the attachment comprising:

a housing;

a first shaft integrally connectable to the main spindle, the first shaft being supported on the housing in a rotatable manner;

a second shaft having an axial direction different from an axial direction of the first shaft, the second shaft being supported on the housing in a rotatable manner;

a plurality of tool mounting shafts having an axial direction parallel to the axial direction of the second shaft, the plurality of tool mounting shafts being supported on the housing in a rotatable manner;

a rotation axis conversion gear mechanism arranged in the housing, the rotation axis conversion gear mechanism being configured to transmit a driving force from the first shaft to the second shaft to change a direction of the rotation axis; and a synchronous rotation mechanism arranged in the housing, the synchronous rotation mechanism being configured to transmit a driving force of the second shaft to the plurality of tool mounting shafts, and rotate the plurality of tool mounting shafts at the same rotational speed and with synchronous phase angles.

The term "cleaning" herein refers to clearing by jetting a cleaning liquid from a nozzle, deburring with a machining tool such as a polisher or a reamer or with a cutting tool, polishing with a brush, cleaning or drying by blowing air, or other machining or processing.

The cleaning tool attachment according to one or more embodiments of the present invention reduces the amount of foreign matter or cleaning liquid remaining on a workpiece.

DETAILED DESCRIPTION

First Embodiment

Figure 1:
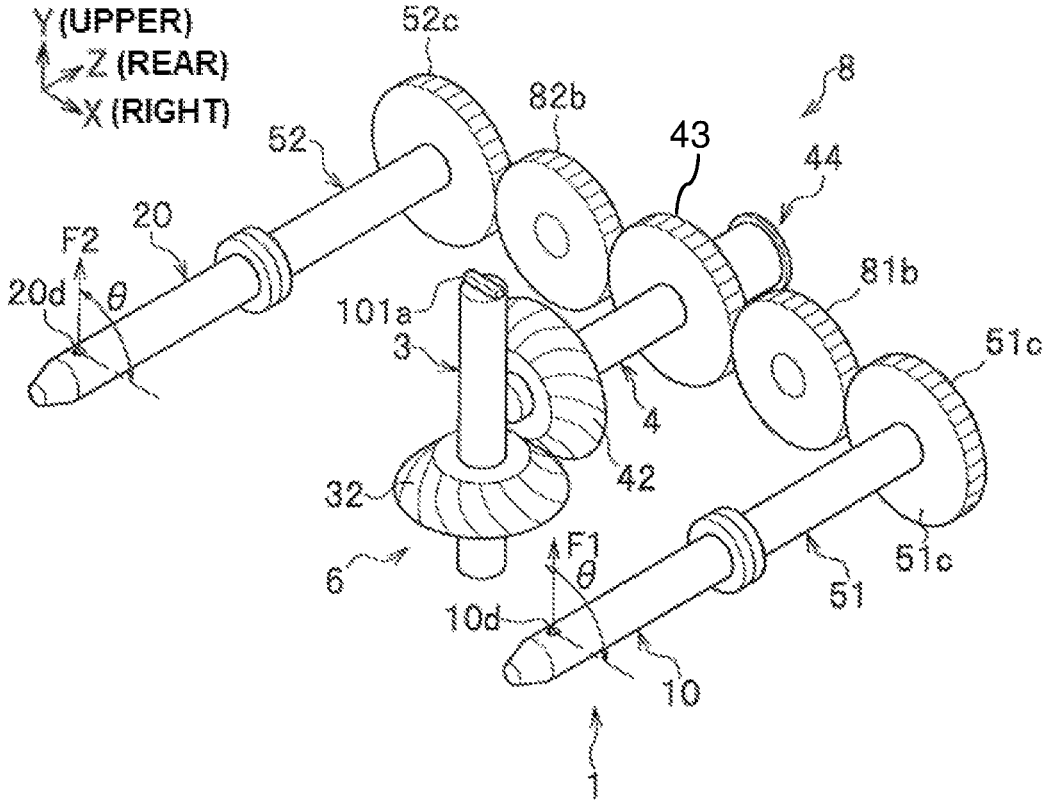
FIG. 1 is a schematic perspective view of a rotation axis conversion gear mechanism and a synchronous rotation mechanism arranged in a cleaning tool attachment according to a first embodiment.

A cleaning tool attachment 1 according to a first embodiment will now be described with reference to FIGS. 1 to 5B. FIG. 1 shows the arrangement of a rotation axis conversion gear mechanism and a synchronous rotation mechanism. For ease of explanation, the tooth trace directions of the gears are indicated by lines.

Figure 4A:
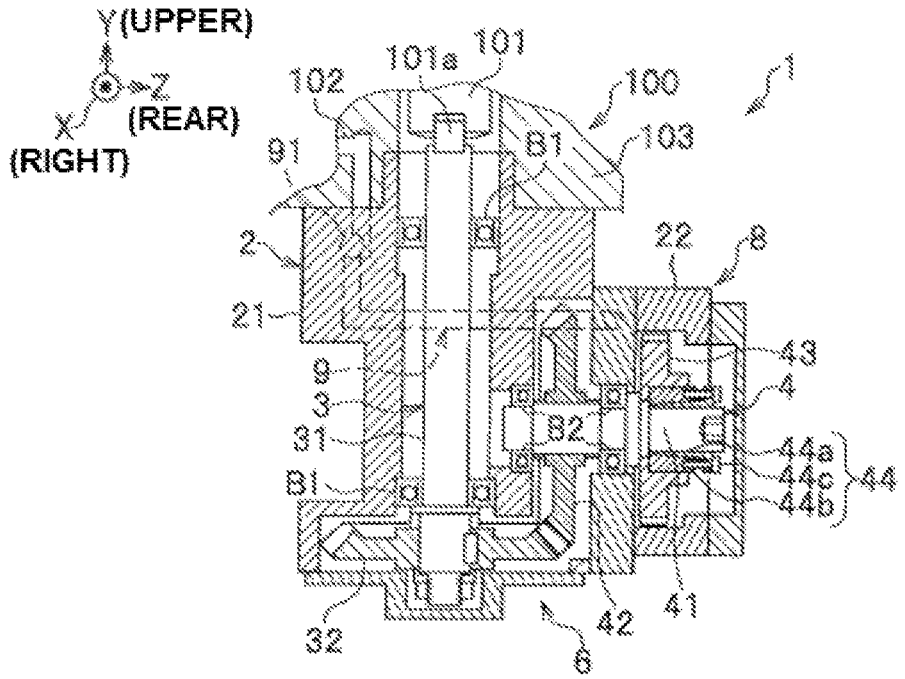
FIG. 4A is a cross-sectional view taken along line A-A in FIG. 4B.
Figure 4B:
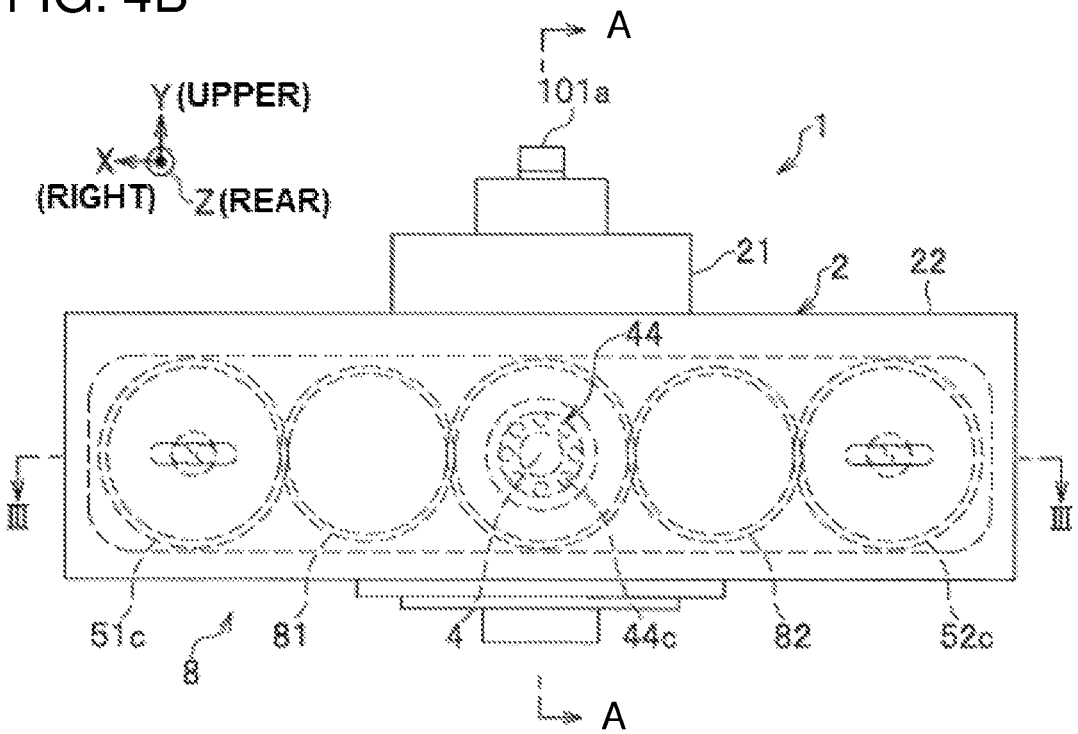
FIG. 4B is a rear view of the cleaning tool attachment according to the first embodiment.

As shown in FIG. 4A, the cleaning tool attachment 1 is a connector to a main spindle 101 arranged in a turret 103 included in a cleaning device 100. The cleaning tool attachment 1 is also an adapter for mounting a first cleaning tool 10 and a second cleaning tool 20 on the main spindle 101.

The cleaning device 100 uses cleaning tools mounted on its rotatable main spindle 101 to clean or deburr a workpiece. The angle of rotation of the main spindle 101 is controllable. Although not limiting, the cleaning device 100 may use replaceable cleaning tools. For example, the cleaning device 100 is a vertical turret type cleaning device described in Patent Literature 1. The cleaning device 100 may be a vertical cleaning device with an automatic tool changer including a tool magazine.

The axes and orientations referred to in the present embodiment, including X, Y, and Z axes and upper and lower, right and left, and front and rear sides, are mere examples. Various cleaning devices may use different axes or orientations.

As shown in FIG. 1, the cleaning tool attachment 1 transmits the rotation of the main spindle 101 to the first cleaning tool 10 and the second cleaning tool 20. The cleaning tool attachment 1 rotates the first cleaning tool 10 and the second cleaning tool 20 at the same rotational speed and at the same phase angle (rotation angle from a predetermined origin), and with synchronous phase angles θ for a jet flow F1 from the first cleaning tool 10 and for a jet flow F2 from the second cleaning tool 20.

The cleaning tool attachment 1 thus allows simultaneous cleaning of a plurality of workpieces or a plurality of cleaning target areas of a single workpiece arranged in parallel. A workpiece may be, for example, a valve body, an anti-lock brake system (ABS) body, a brake master cylinder, or a starter motor gear box.

Figure 3:
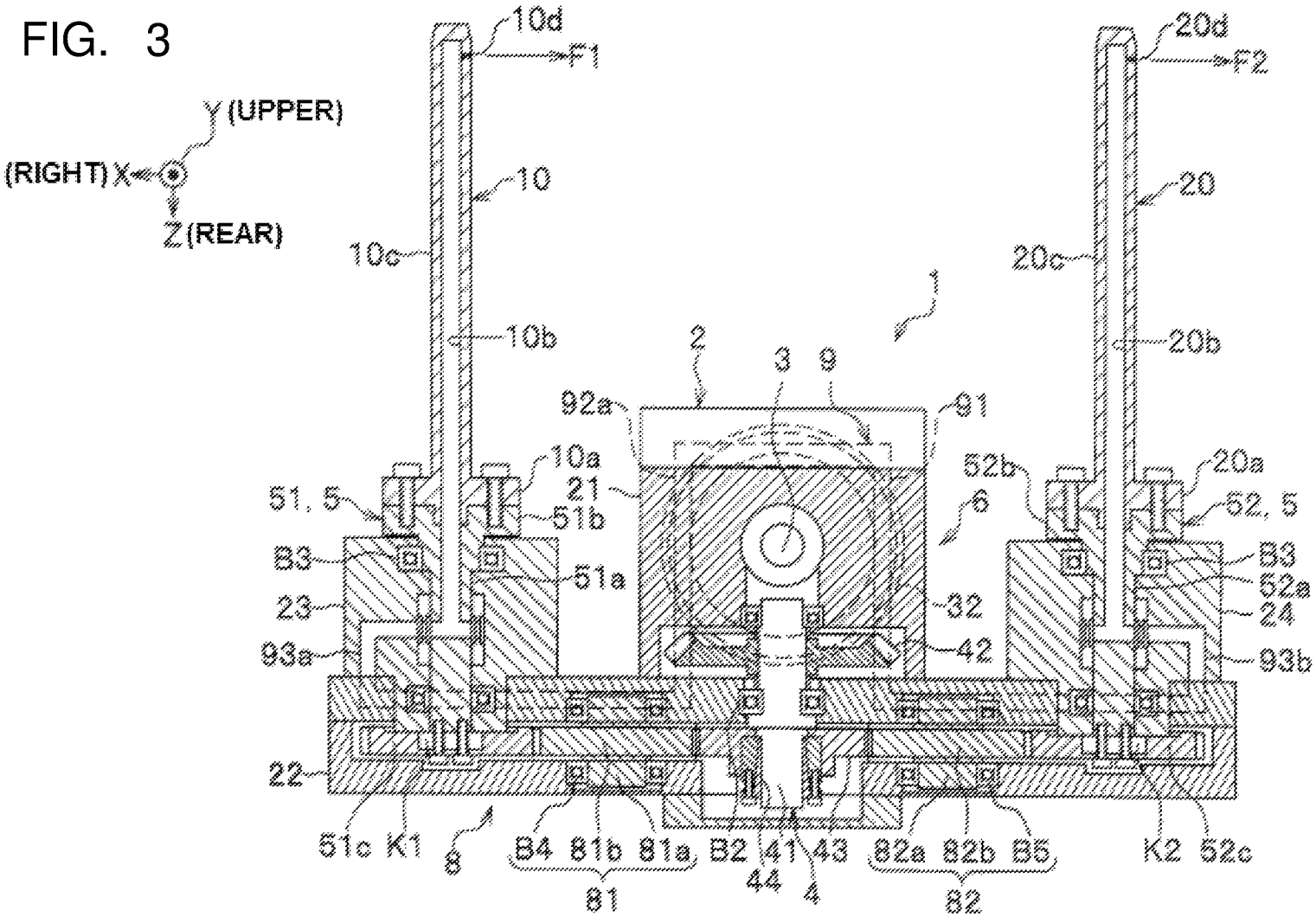
FIG. 3 is a cross-sectional view taken along line III-III in FIG. 4B.

As shown in FIGS. 3 and 4A, the cleaning tool attachment 1 includes a housing 2, a first shaft 3, a second shaft 4, a plurality of tool mounting shafts 5, a rotation axis conversion gear mechanism 6, a synchronous rotation mechanism 8, and a cleaning liquid channel 9. The housing 2 is connected to the cleaning device 100. The first shaft 3 is connected to the main spindle 101. The second shaft 4 is arranged in an axial direction different from the axial direction of the first shaft 3. The tool mounting shafts 5 are a first tool mounting shaft 51 and a second tool mounting shaft 52, which are parallel to the axial direction of the second shaft 4. The tool mounting shafts 5 are supported on the housing 2 in a rotatable manner. The rotation axis conversion gear mechanism 6 transmits a driving force from the first shaft 3 to the second shaft 4 to change the direction of the rotation axis. The synchronous rotation mechanism 8 rotates the plurality of tool mounting shafts 5 (51 and 52) at the same rotational speed and with synchronous phase angles θ. The cleaning liquid channel 9 feeds a cleaning liquid to the first cleaning tool 10 and the second cleaning tool 20.

The first cleaning tool 10 and the second cleaning tool 20 are cleaning nozzles with the same shape (L-shaped nozzles). The first cleaning tool 10 will now be described. The second cleaning tool 20 is given the same reference numerals (alphabetical letters) as the first cleaning tool 10, and will not be described in detail.

The first cleaning tool 10 includes a mounting seat 10*a*, a nozzle shaft 10*c*, and a nozzle hole 10*d*. The mounting seat 10*a* is fixed to the first tool mounting shaft 51. The nozzle shaft 10*c* has an internal distribution channel 10*b* for a cleaning liquid. The nozzle shaft 10*c* has the nozzle hole 10*d* in its tip, through which the cleaning liquid is jetted.

The first cleaning tool 10 jets the cleaning liquid from the nozzle hole 10*d* as the jet flow F1, after the cleaning liquid is fed from the turret 103 to the distribution channel 10*b* through the cleaning liquid channel 9. The second cleaning tool 20 jets the cleaning liquid from a nozzle hole 20*d* as the jet flow F2, after the cleaning liquid is fed from the turret 103 to the distribution channel 20*b* through the cleaning liquid channel 9.

The first cleaning tool 10 is fixed to the mounting seat 10*a* of the first tool mounting shaft 51 with keys or pins. The first cleaning tool 10 rotates integrally with the first tool mounting shaft 51 to achieve positioning in the rotating direction.

Each of the first cleaning tool 10 and the second cleaning tool 20 may be a cleaning tool other than the L-shaped nozzle in the present embodiment, and may be, for example, a direct jet nozzle for jetting a cleaning liquid from the tip of its shaft along the central axis, a rotational nozzle having a plurality of nozzle holes in its tip, a cleaning lance, a twisted brush, a cup brush, or another cleaning tool known in the art.

The housing 2 includes a head 21, a gear case 22, a first bearing case 23, and a second bearing case 24. The head 21, which is box shaped, is connected to the cleaning device 100. The head 21 axially supports the first shaft 3 and the second shaft 4 in a rotatable manner. The gear case 22 is fixed under the head 21. The tool mounting shafts 5 are attached to the gear case 22. The gear case 22 contains the synchronous rotation mechanism 8 including a plurality of gears. The first bearing case 23 and the second bearing case 24 are attached to the gear case 22. The first bearing case 23 supports the first tool mounting shaft 51 in a rotatable manner. The second bearing case 24 supports the second tool mounting shaft 52 in a rotatable manner.

The first shaft 3 includes a shaft member 31, a bevel gear 32, and bearings B1. The shaft member 31 is coaxially connected to the main spindle 101 with a key 101*a*. The shaft member 31 rotates integrally with the main spindle 101. When, for example, the main spindle 101 of the vertical cleaning device 100 extends in the vertical direction (Y-direction), the shaft member 31 is also arranged in the vertical direction.

The bevel gear 32 (first bevel gear) is fixed to a lower portion of the shaft member 31. The bearings B1 support the shaft member 31 in a rotatable manner. The bevel gear 32 is a component of the rotation axis conversion gear mechanism 6. Although the bevel gear 32 is a spiral bevel gear in the present embodiment (refer to FIG. 1) to reduce vibrations or noise further, the bevel gear 32 may be a straight bevel gear.

The second shaft 4 includes a shaft member 41, a bevel gear 42, a drive gear 43, a drive gear fastener 44, and bearings B2. The shaft member 41 serves as the axis of rotation. The bevel gear 42 (second bevel gear) is fixed to a front portion of the shaft member 41. The drive gear 43 is arranged on a back portion of the shaft member 41. The drive gear fastener 44 is arranged on a rear end of the drive gear 43. The bearings B2 support the shaft member 41 in a rotatable manner.

The shaft member 41 is arranged to have an axial direction different from the axial direction of the shaft member 31 of the first shaft 3. The shaft member 41 in the present embodiment extends in the horizontal direction (Z-direction), which is perpendicular to the shaft member 31. This allows the plurality of tool mounting shafts to rotate in an axial direction different from the axial direction of the main spindle.

The bevel gear 42 is a component of the rotation axis conversion gear mechanism 6. Although the bevel gear 42 is a spiral bevel gear in the present embodiment (refer to FIG. 1) to reduce vibrations or noise further, the bevel gear 42 may be a straight bevel gear.

The rotation axis conversion gear mechanism 6 includes the bevel gears 32 and 42.

Although the rotation axis conversion gear mechanism 6 according to the present embodiment converts the rotation axis of the second shaft 4 to the horizontal direction (Z-direction) perpendicular to the axial direction (Y-direction) of the first shaft 3, the rotation axis conversion may not be limited to this structure. For example, the angle formed by the first shaft 3 and the second shaft 4 may be set to any angle determined in accordance with the shape of a workpiece, such as 60, 80, or 120 degrees.

The rotation axis conversion gear mechanism 6 may be a crossed helical gear mechanism or a worm gear mechanism, in place of the bevel gear mechanism combining the bevel gears 32 and 42.

As shown in FIG. 1, the drive gear 43 is a spur gear included in the synchronous rotation mechanism 8. The drive gear 43 is a drive source of the synchronous rotation mechanism 8. The drive gear 43 is attached to the shaft member 41 via the drive gear fastener 44.

The drive gear fastener 44 is a friction lock. The drive gear fastener 44 connects the shaft member 41 and the drive gear 43 in an integrally rotatable manner or disconnects the shaft member 41 and the drive gear 43 in an independently rotatable manner.

As shown in FIG. 4A, the drive gear fastener 44 includes a flange ring 44*a*, a slit ring 44*b*, and lock bolts 44*c*. The flange ring 44*a* is mounted externally on the shaft member 41 between the inner periphery of the drive gear 43 and the outer periphery of the shaft member 41. The slit ring 44*b* is mounted externally on the flange ring 44*a*. The lock bolts 44*c* axially move the slit ring 44*b* with respect to the flange ring 44*a*. The outer periphery of the flange ring 44*a* and the inner periphery of the slit ring 44*b* form a sloped surface with the diameter increasing toward its rear end in the axial direction (positive Z direction).

Figure 5A:
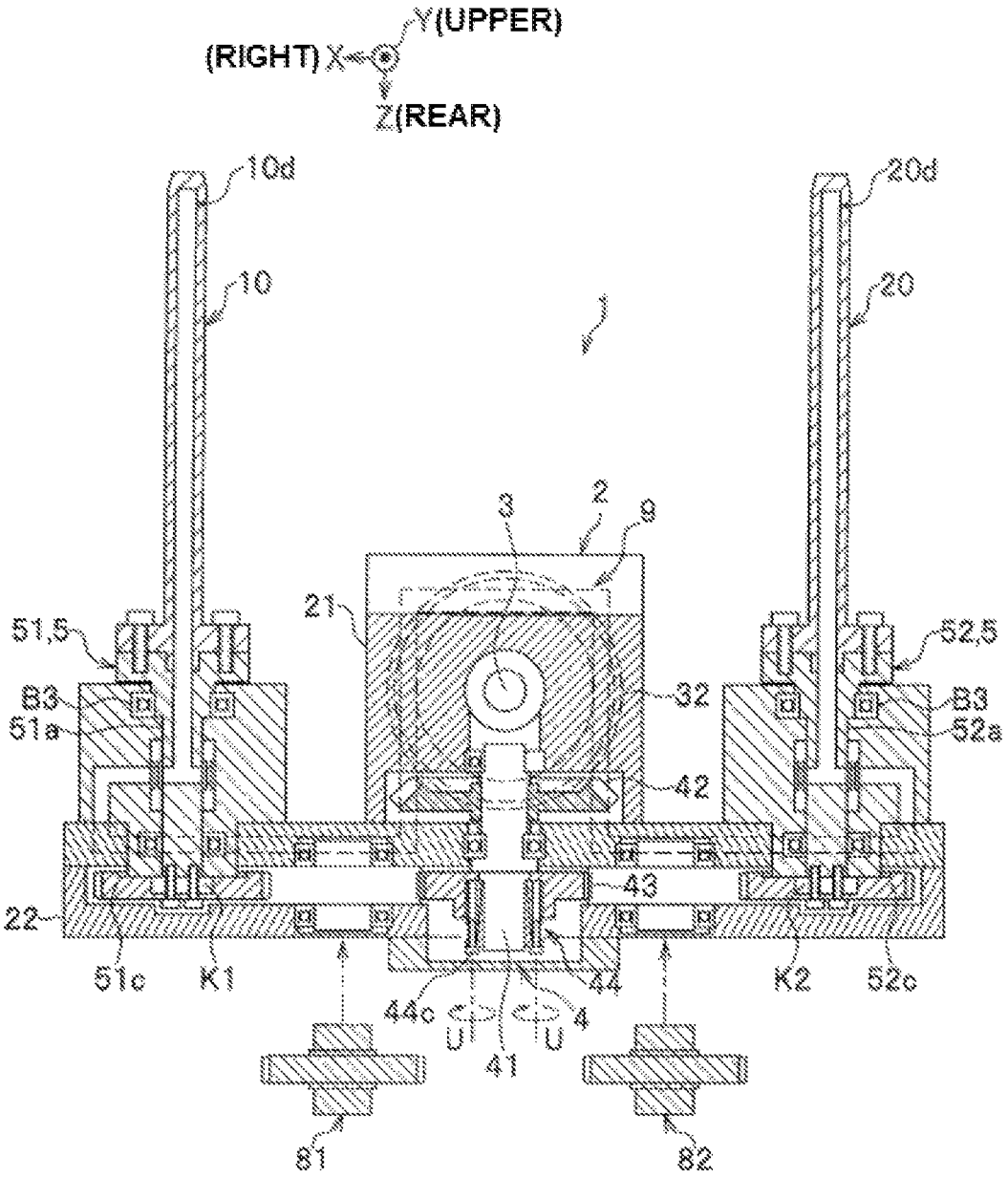
FIG. 5A is a planar cross-sectional view of the cleaning tool attachment according to the first embodiment describing its assembling method and is also an overall view describing loosening of a drive gear fastener.
Figure 5B:
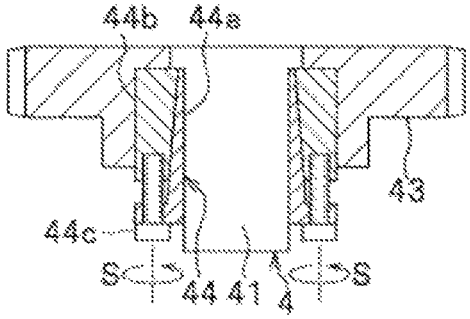
FIG. 5B is a partially enlarged view describing fastening of the drive gear fastener.

As shown in FIG. 5B, when the lock bolts 44*c* are tightened clockwise (in direction S), the slit ring 44*b* increases its diameter along the sloped surface, and the flange ring 44*a* decreases its diameter. The axial force of each lock bolt 44*c* is seemingly the resultant of an axial component force acting along the sloped surface and a radial component force acting in the direction perpendicular to the sloped surface. The radial component force urges the slit ring 44*b* toward the drive gear 43. The resultant reaction force then urges the flange ring 44*a* toward the shaft member 41. A frictional force occurs between the slit ring 44*b* and the drive gear 43 in accordance with the axial component force of the lock bolts 44*c*. A frictional force also occurs between the flange ring 44*a* and the shaft member 41. With the frictional force, the drive gear fastener 44 fixes the shaft member 41 and the drive gear 43 integrally.

As shown in FIG. 5A, when the lock bolts 44*c* are loosened counterclockwise (in direction U), the slit ring 44*b* moves backward along the sloped surface, and decreases its diameter. This creates a gap between the shaft member 41 and the drive gear 43 to disconnect the shaft member 41 and the drive gear 43, which then become independently rotatable.

The drive gear fastener 44 in the present embodiment is the friction lock using the wedge effect of the sloped surface, which has the simple structure and can function in a reliable manner. The drive gear fastener 44 may have one of various other lock mechanisms known in the art, such as a coupling lock.

As shown in FIG. 3, the first tool mounting shaft 51 and the second tool mounting shaft 52 are arranged symmetric with respect to a plane extending along the axial line of the first shaft 3 and the axial line of the second shaft 4 (YZ plane). This allows the plurality of tool mounting shafts 5 (51 and 52) to be arranged in a narrow space for flexible use with various workpieces.

The first tool mounting shaft 51 and the second tool mounting shaft 52 arranged at different positions have the same structure. The structure of the first tool mounting shaft 51 will now be described, and the second tool mounting shaft 52 will not be described in detail.

The first tool mounting shaft 51 includes a shaft member 51*a*, a tool mounting portion 51*b*, a first gear 51*c*, a channel 93*a*, and bearings B3. The shaft member 51*a* serves as a rotation axis. The tool mounting portion 51*b* is arranged on a front end of the shaft member 51*a*. The first gear 51*c* is fixed to a rear end of the shaft member 51*a* with a key K1. The bearings B3 support the shaft member 51*a* in a rotatable manner.

The synchronous rotation mechanism 8 transmits a driving force of the second shaft 4 to the tool mounting shafts 5 (51 and 52). The synchronous rotation mechanism 8 includes the drive gear 43, the first gear 51*c*, a second gear 52*c*, a first idler gear 81, and a second idler gear 82. The first idler gear 81 transmits power from the drive gear 43 to the first gear 51*c*. The second idler gear 82 transmits power from the drive gear 43 to the second gear 52*c*.

The first idler gear 81 includes a shaft 81*a* and a spur gear 81*b*. The shaft 81*a* is supported by bearings B4 in a rotatable manner. The second idler gear 82 includes a shaft 82*a* and a spur gear 82*b*. The shaft 82*a* is supported by bearings B5 in a rotatable manner.

The first gear 51*c* has the same number of teeth as the second gear 52*c*. The number of idler gears arranged between the drive gear 43 and the first gear 51*c* is equal to the number of idler gears arranged between the drive gear 43 and the second gear 52*c*. The gear ratio between the first gear 51*c* and the drive gear 43 is thus identical to the gear ratio between the second gear 52*c* and the drive gear 43. Further, the first gear 51*c* and the second gear 52*c* rotate in the same direction, thus synchronizing the rotational speeds of the first gear 51*c* and the second gear 52*c*.

The synchronous rotation mechanism 8 can have any other structure known in the art. For example, the synchronous rotation mechanism 8 may combine an endless chain and a spline, a toothed belt and a toothed pulley, or a bevel gear and a drive shaft.

Figure 2:
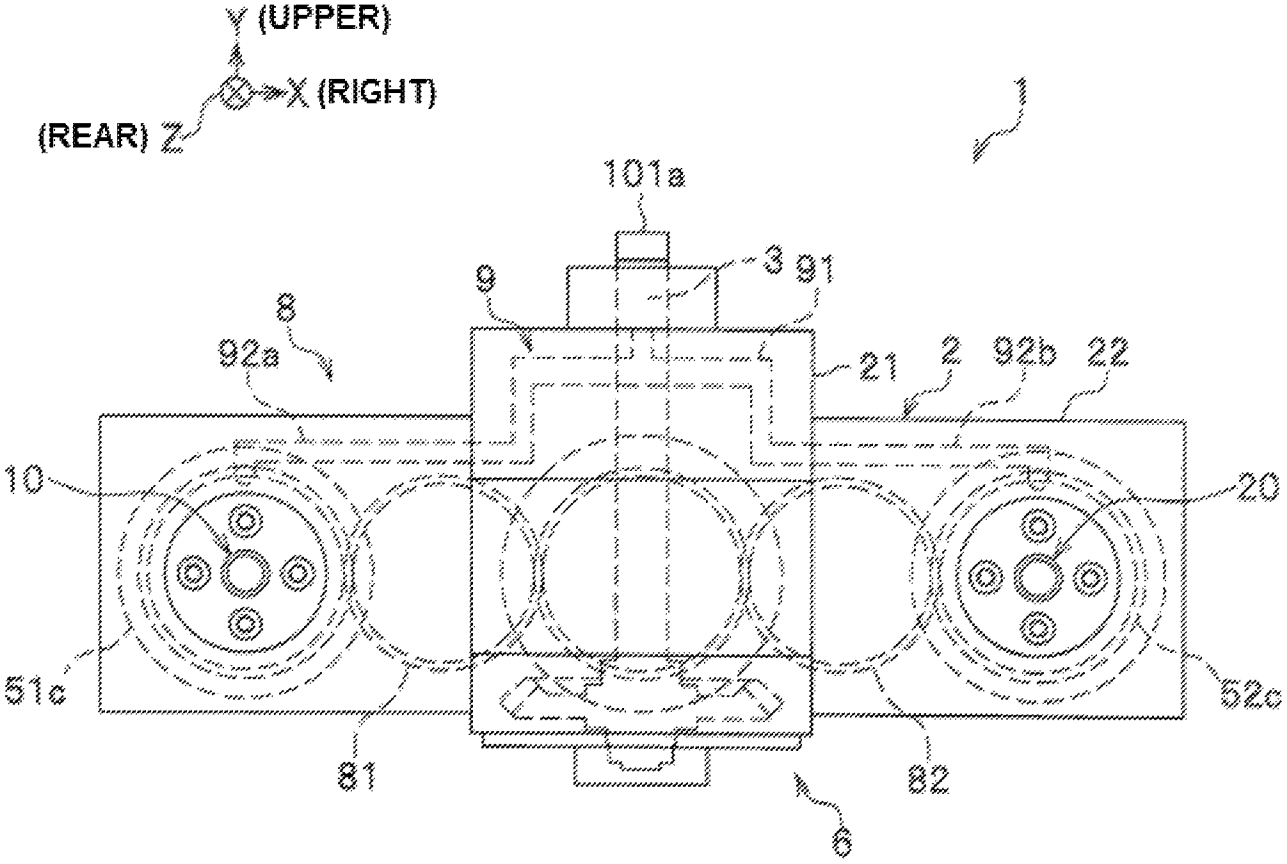
FIG. 2 is a front view of the cleaning tool attachment according to the first embodiment.

As shown in FIG. 2, FIG. 3, and FIG. 4A, the cleaning liquid channel 9 feeds a cleaning liquid from a cleaning liquid inlet 102 in a top portion of the turret 103 to the first cleaning tool 10 and the second cleaning tool 20 through the housing 2. The cleaning liquid channel 9 includes a channel 91, channels 92*a* and 92*b*, and channels 93*a* and 93*b*. The channel 91 communicates with the cleaning liquid inlet 102. The channel 91 is defined in an upper portion of the housing 2 and is U-shaped as viewed from above. The channels 92*a* and 92*b* extend from the channel 91. The channel 92*a* communicates with the first tool mounting shaft 51. The channel 92*b* communicates with the second tool mounting shaft 52. The channel 92*a* is reverse-L-shaped as viewed from the front. The channel 92*b* is L-shaped as viewed from the front. The channel 93*a* is arranged in the first bearing case 23. The channel 93*b* is arranged in the second bearing case 24. The channel 93*a* extends from the channel 92*a* and communicates with the distribution channel 10*b*. The channels 93*a* and 93*b* each include a rotary joint, which surrounds the shaft member 51*a* or 52*a*. The channel 93*b* extends from the channel 92*b* and communicates with the distribution channel 20*b*.

Referring now to FIG. 5, a method for assembling the cleaning tool attachment 1 of the first embodiment will now be described.

The synchronous rotation mechanism 8 of the first embodiment includes the drive gear 43, the first gear 51*c*, the second gear 52*c*, the first idler gear 81, and the second idler gear 82, each of which is a spur gear. The drive gear 43 is mounted on the shaft member 41 via the drive gear fastener 44. The synchronous rotation mechanism 8 with this structure may be assembled with the procedure described below.

First, the lock bolts 44*c* of the drive gear fastener 44 are loosened.

As shown in FIG. 5A, the lock bolts 44*c* are loosened counterclockwise U. Loosening the lock bolts 44*c* disconnects the second shaft 4 and the drive gear 43 to allow each of the second shaft 4, the bevel gear 42, the bevel gear 32, and the first shaft 3 to rotate independently with respect to the drive gear 43.

The synchronous rotation mechanism is then mounted onto the structure.

The first gear 51*c* is fixed to the shaft member 51*a* with the key K1. The shaft member 51*a* is then mounted onto the gear case 22. The second gear 52*c* is fixed to the shaft member 52*a* with a key K2. The shaft member 52*a* is mounted onto the gear case 22. In this process, the first idler gear 81 and the second idler gear 82 are not mounted yet.

Subsequently, the phase angles of the first cleaning tool 10 and the second cleaning tool 20 are set to the same angle.

Without the first idler gear 81 and the second idler gear 82 mounted yet, the first cleaning tool 10 and the second cleaning tool 20 can rotate independently. The phase angles θ of the nozzle hole 10*d* of the first cleaning tool 10 and the nozzle hole 20*d* of the second cleaning tool 20 are set to a predetermined origin.

The first idler gear 81 and the second idler gear 82 are mounted onto the structure.

The phase angle of the first cleaning tool 10 is maintained at the origin. In this state, the first idler gear 81 is mounted. The first idler gear 81 is a spur gear. Thus, the drive gear 43 is slid in the axial direction without rotating while maintaining the phase angle, and the first idler gear 81 is mounted. Likewise, the phase angle of the second cleaning tool 20 is maintained, and the second idler gear 82 is mounted. The second idler gear 82 is a spur gear. Thus, the drive gear 43 is slid in the axial direction without rotating while maintaining the phase angle, and the second idler gear 82 is mounted.

Subsequently, the cleaning tool attachment 1 is fixed to the turret 103 of the cleaning device 100.

The cleaning device 100 is operated to set the rotation angle of the main spindle 101 to the origin.

Loosening the lock bolts 44*c* allows the first shaft 3 to rotate independently with respect to the drive gear 43. The phase angles θ of the first cleaning tool 10 and the second cleaning tool 20 are set to the predetermined origin, and the first shaft 3 is engaged with the main spindle 101 of the cleaning device 100 with the key 101*a* to fix the cleaning tool attachment 1 to the turret 103. In this manner, the drive gear fastener 44 allows the same phase angle θ to be easily set for the first cleaning tool 10 and the second cleaning tool 20.

Through the above processes, the same phase angle θ is set for the nozzle hole 10*d* and the nozzle hole 20*d*, and the cleaning tool attachment 1 is fixed to the main spindle 101 of the cleaning device 100.

As shown in FIG. 5B, the lock bolts 44*c* are tightened clockwise S to fix the second shaft 4 and the drive gear 43 in an integrally rotatable manner.

Second Embodiment

A second embodiment will now be described with reference to FIGS. 6 to 7B.

A cleaning tool attachment 1A according to the second embodiment differs from the cleaning tool attachment 1 of the first embodiment mainly in its synchronous rotation mechanism 8A. The components of the cleaning tool attachment 1A different from the components in the first embodiment will be described. The components in the second embodiment identical to those in the first embodiment are given the same reference numerals, and will not be described.

The synchronous rotation mechanism 8A according to the second embodiment includes a drive gear 43A, a first gear 51Ac, a second gear 52Ac, a first idler gear 81A, and a second idler gear 82A, each of which is a helical gear or a double-helical gear. The synchronous rotation mechanism 8A thus differs from the synchronous rotation mechanism 8 of the first embodiment including the drive gear 43, the first gear 51*c*, the second gear 52*c*, the first idler gear 81, and the second idler gear 82 that are spur gears.

The drive gear 43A according to the second embodiment is engaged with a key K4 and is fixed to the shaft member 41A with a locknut 45. The first gear 51Ac is mounted on a shaft member 51Aa of a first tool mounting shaft 51A via a first gear fastener 44A. The second gear 52Ac is mounted on a shaft member 52Aa of a second tool mounting shaft 52A via a second gear fastener 44A. The cleaning tool attachment 1A thus differs from the cleaning tool attachment 1 of the first embodiment including the drive gear 43 fixed to the shaft member 41 via the drive gear fastener 44.

The first gear fastener 44A is a friction lock. The first gear fastener 44A connects the shaft member 51Aa and the first gear 51Ac in an integrally rotatable manner or disconnects the shaft member 51Aa and the first gear 51Ac in an independently rotatable manner. The second gear fastener 44A is a friction lock. The second gear fastener 44A connects the shaft member 52Aa and the second gear 52Ac in an integrally rotatable manner or disconnects the shaft member 52Aa and the second gear 52Ac in an independently rotatable manner.

The first gear fastener 44A and the second gear fastener 44A have the same structure as the drive gear fastener 44.

The cleaning tool attachment 1A according to the second embodiment includes the synchronous rotation mechanism 8A including, for example, a helical gear, and thus can reduce noise or vibrations further. A procedure for assembling the cleaning tool attachment 1A according to the second embodiment will now be described with reference to FIGS. 6 to 7B.

First, the synchronous rotation mechanism 8A is mounted onto the structure.

Figure 6:
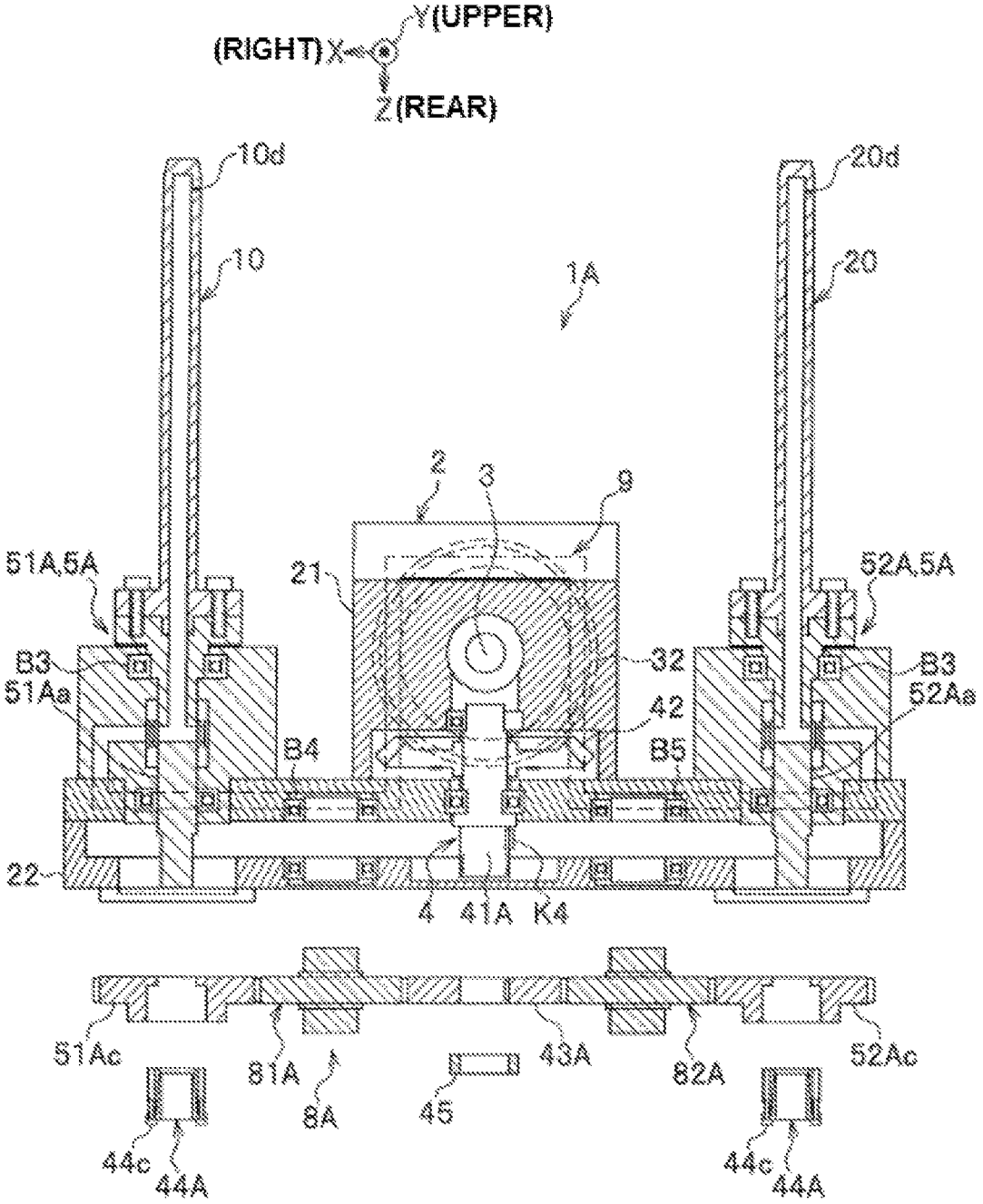
FIG. 6 is an exploded planar cross-sectional view of a cleaning tool attachment according to a second embodiment describing its components and its assembling method.

As shown in FIG. 6, the drive gear 43A, the first gear 51Ac, the second gear 52Ac, the first idler gear 81A, and the second idler gear 82A, which are included in the synchronous rotation mechanism 8A, mesh with one another and are assembled together. The drive gear 43A is mounted on the shaft member 41A. The first gear 51Ac is mounted on the shaft member 51Aa. The second gear 52Ac is mounted on the shaft member 52Aa. The first idler gear 81A is mounted on bearings B4. The second idler gear 82A is mounted on bearings B5.

Figure 7A:
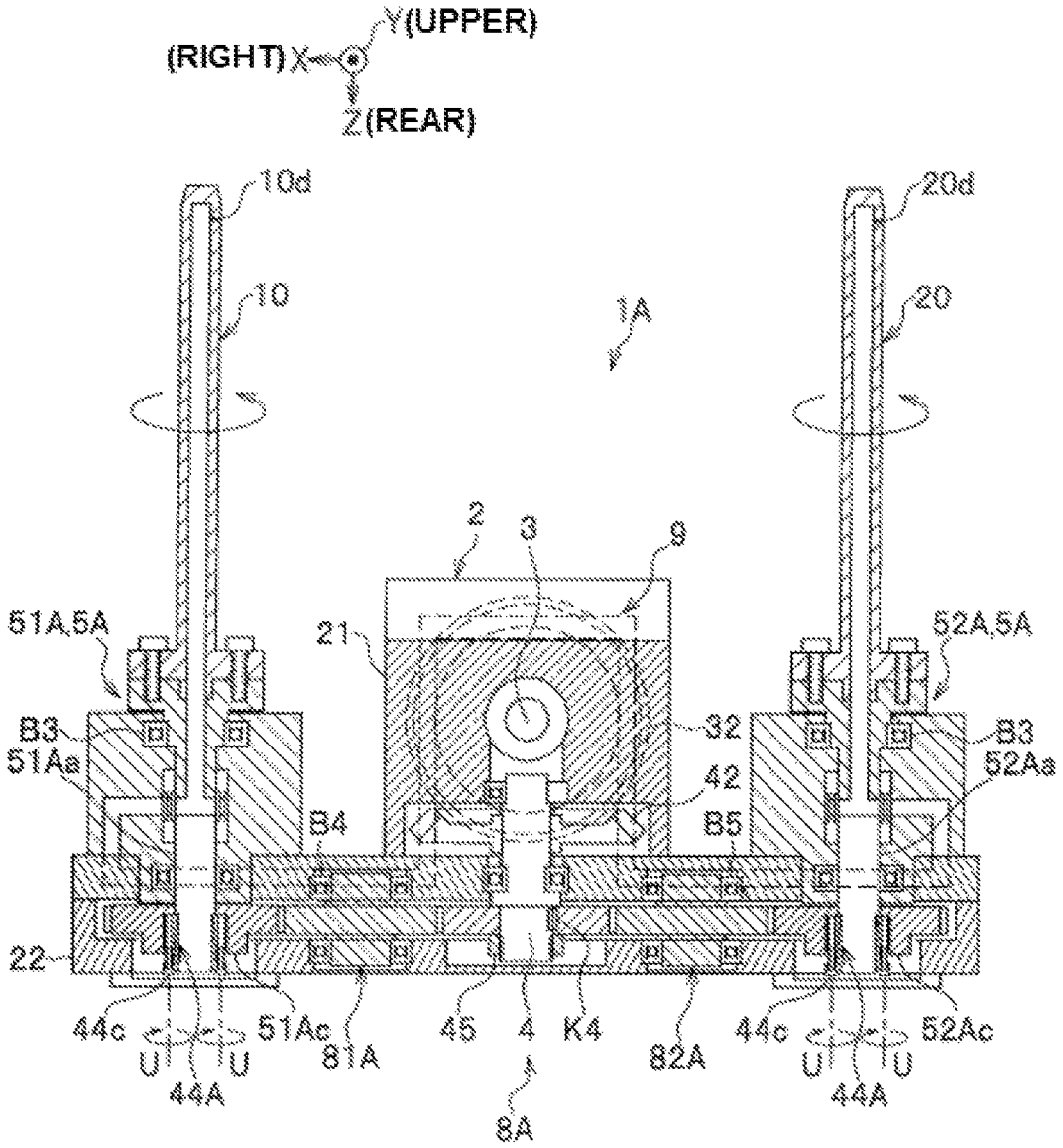
FIG. 7A is an exploded planar cross-sectional view of the cleaning tool attachment according to the second embodiment describing its assembling method and is also an overall view describing loosening of first and second gear fasteners.

As shown in FIG. 7A, the drive gear 43A is engaged with the key K4 and is fixed to the shaft member 41A with the locknut 45. The first gear fastener 44A is mounted on the first gear 51Ac. The lock bolts 44*c* of the first gear fastener 44A are loosened counterclockwise U. The second gear fastener 44A is mounted on the second gear 52Ac. The lock bolts 44*c* of the second gear fastener 44A are loosened counterclockwise U.

Subsequently, the phase angles of the first cleaning tool 10 and the second cleaning tool 20 are set to the same angle.

Loosening the lock bolts 44*c* of the first gear fastener 44A disconnects the first gear 51Ac and the shaft member 51Aa. Loosening the lock bolts 44*c* of the second gear fastener 44A disconnects the second gear 52Ac and the shaft member 52Aa.

This allows the shaft member 51Aa to rotate independently of the first gear 51Ac, and allows the shaft member 52Aa to rotate independently of the second gear 52Ac.

Subsequently, the cleaning device 100 is operated to set the rotation angle of the main spindle 101 to the origin. The cleaning tool attachment 1A is fixed to the turret 103 of the cleaning device 100.

The lock bolts 44*c* of the first gear fastener 44A and the second gear fastener 44A are loosened to set the same phase angle θ for the nozzle hole 10*d* of the first cleaning tool 10 and the nozzle hole 20*d* of the second cleaning tool 20.

Figure 7B:
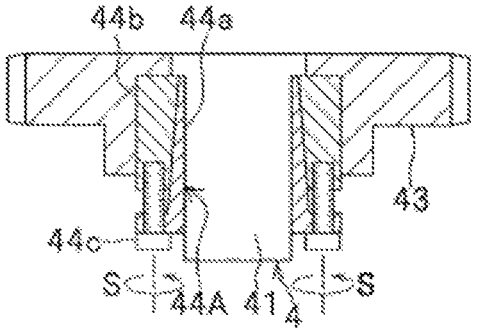
FIG. 7B is a partially enlarged view describing fastening of the first and the second gear fasteners.

As shown in FIG. 7B, the lock bolts 44*c* of the first gear fastener 44A and the second gear fastener 44A are tightened clockwise S. This fixes the first gear 51Ac and the shaft member 51Aa in an integrally rotatable manner, and the second gear 52Ac and the shaft member 52Aa in an integrally rotatable manner.

The cleaning tool attachments 1 and 1A according to the above embodiments allow the first cleaning tool 10 and the second cleaning tool 20 to rotate in the horizontal direction (Z-direction) perpendicular to the main spindle 101 of the cleaning device 100. This allows chips and the cleaning liquid to be removed more efficiently during cleaning, and achieves effective cleaning or draining.

The synchronous rotation mechanisms 8 and 8A according to the above embodiments allow the first cleaning tool 10 and the second cleaning tool 20 to rotate at the same rotational speed and with synchronous phase angles θ. This structure allows the first cleaning tool 10 and the second cleaning tool 20 to operate in synchronization to clean a plurality of workpieces or a plurality of target cleaning areas arranged parallel to one another and spaced in correspondence with the interval between the first cleaning tool 10 and the second cleaning tool 20.

The first cleaning tool 10 and the second cleaning tool 20 are set to have the predetermined phase angle θ in correspondence with their cleaning targets. This structure enables efficient and reliable cleaning of a plurality of workpieces or a plurality of cleaning target areas.

Although the invention has been described based on the embodiments, these embodiments may be modified variously. For example, although the present embodiment describes the adapter for connecting two cleaning tools, namely the first cleaning tool 10 and the second cleaning tool 20, the adapter may be designed for three or more cleaning tools in accordance with the number of workpieces or cleaning target areas.

REFERENCE SIGNS LIST

1, 1A cleaning tool attachment
2 housing
3 first shaft
4 second shaft
5, 5A tool mounting shaft
6 rotation axis conversion gear mechanism
8, 8A synchronous rotation mechanism
9 cleaning liquid channel
10 first cleaning tool
20 second cleaning tool
31 shaft member
32 bevel gear (first bevel gear)
41, 41A shaft member
42 bevel gear (second bevel gear)
43, 43A drive gear
44 drive gear fastener
44A first gear fastener, second gear fastener
51, 51A first tool mounting shaft
51*a*, 51Aa shaft member
51*b* tool mounting portion
51*c*, 51Ac first gear
52, 52A second tool mounting shaft
52*a*, 52Aa shaft member
52*c*, 52Ac second gear
81, 81A first idler gear
81*a* shaft
81*b* spur gear
82, 82A second idler gear
82*a* shaft
82*b* spur gear
100 cleaning device
101 main spindle
101*a* key

What is claimed is:

1. A cleaning tool attachment for mounting a plurality of cleaning tools onto a main spindle of a cleaning device, the attachment comprising:

a housing;

a first shaft integrally connectable to the main spindle to have a common axis, the first shaft supported on the housing in a rotatable manner;

a second shaft having an axial direction different from an axial direction of the first shaft, the second shaft being supported on the housing in a rotatable manner;

a plurality of tool mounting shafts having an axial direction parallel to the axial direction of the second shaft, the plurality of tool mounting shafts being supported on the housing in a rotatable manner, the plurality of tool mounting shafts configured to be fed with a cleaning liquid simultaneously;

a rotation axis conversion gear mechanism arranged in the housing, the rotation axis conversion gear mechanism being configured to transmit a driving force from the first shaft to the second shaft to change a direction of the rotation axis; and a synchronous rotation mechanism arranged in the housing, the synchronous rotation mechanism being configured to transmit a driving force of the second shaft to the plurality of tool mounting shafts, and rotate the plurality of tool mounting shafts about each tool mounting shaft at the same rotational speed and with synchronous phase angles.

2. The cleaning tool attachment according to claim 1, wherein the rotation axis conversion gear mechanism includes a first bevel gear fixed to the first shaft, and a second bevel gear fixed to the second shaft.

3. The cleaning tool attachment according to claim 2, wherein the plurality of tool mounting shafts include a first tool mounting shaft and a second tool mounting shaft arranged around the second shaft, and the synchronous rotation mechanism includes a drive gear arranged on the second shaft and configured to rotate the plurality of tool mounting shafts, a first gear arranged on the first tool mounting shaft and configured to receive a driving force from the drive gear, and a second gear arranged on the second tool mounting shaft and configured to receive a driving force from the drive gear, the second gear configured to rotate in the same direction as the first gear at the same rotational speed.

4. The cleaning tool attachment according to claim 3, further comprising:

a drive gear fastener configured to connect the second shaft and the drive gear in an integrally rotatable manner or disconnect the second shaft and the drive gear in an independently rotatable manner.

5. The cleaning tool attachment according to claim 4, wherein the housing includes a cleaning liquid inlet configured to feed a cleaning liquid, and a cleaning liquid channel configured to distribute the cleaning liquid fed from the cleaning liquid inlet to the plurality of tool mounting shafts.

6. The cleaning tool attachment according to claim 3, further comprising:

a first gear fastener configured to connect the first tool mounting shaft and the first gear in an integrally rotatable manner or disconnect the first tool mounting shaft and the first gear in an independently rotatable manner; and a second gear fastener configured to connect the second tool mounting shaft and the second gear in an integrally rotatable manner or disconnect the second tool mounting shaft and the second gear in an independently rotatable manner.

7. The cleaning tool attachment according to claim 6, wherein the housing includes a cleaning liquid inlet configured to feed a cleaning liquid, and a cleaning liquid channel configured to distribute the cleaning liquid fed from the cleaning liquid inlet to the plurality of tool mounting shafts.

8. The cleaning tool attachment according to claim 3, wherein the first tool mounting shaft and the second tool mounting shaft are symmetric with respect to a plane extending along an axial line of the first shaft.

9. The cleaning tool attachment according to claim 8, wherein the housing includes a cleaning liquid inlet configured to feed a cleaning liquid, and a cleaning liquid channel configured to distribute the cleaning liquid fed from the cleaning liquid inlet to the plurality of tool mounting shafts.

10. The cleaning tool attachment according to claim 3, wherein the housing includes a cleaning liquid inlet configured to feed a cleaning liquid, and a cleaning liquid channel configured to distribute the cleaning liquid fed from the cleaning liquid inlet to the plurality of tool mounting shafts.

11. The cleaning tool attachment according to claim 2, wherein the housing includes a cleaning liquid inlet configured to feed a cleaning liquid, and a cleaning liquid channel configured to distribute the cleaning liquid fed from the cleaning liquid inlet to the plurality of tool mounting shafts.

12. The cleaning tool attachment according to claim 1, wherein the plurality of tool mounting shafts include a first tool mounting shaft and a second tool mounting shaft arranged around the second shaft, and the synchronous rotation mechanism includes a drive gear arranged on the second shaft and configured to rotate the plurality of tool mounting shafts, a first gear arranged on the first tool mounting shaft and configured to receive a driving force from the drive gear, and a second gear arranged on the second tool mounting shaft and configured to receive a driving force from the drive gear, and the second gear configured to rotate in the same direction as the first gear at the same rotational speed.

13. The cleaning tool attachment according to claim 12, further comprising:

a drive gear fastener configured to connect the second shaft and the drive gear in an integrally rotatable manner or disconnect the second shaft and the drive gear in an independently rotatable manner.

14. The cleaning tool attachment according to claim 13, wherein the housing includes a cleaning liquid inlet configured to feed a cleaning liquid, and a cleaning liquid channel configured to distribute the cleaning liquid fed from the cleaning liquid inlet to the plurality of tool mounting shafts.

15. The cleaning tool attachment according to claim 12, further comprising:

a first gear fastener configured to connect the first tool mounting shaft and the first gear in an integrally rotatable manner or disconnect the first tool mounting shaft and the first gear in an independently rotatable manner; and a second gear fastener configured to connect the second tool mounting shaft and the second gear in an integrally rotatable manner or disconnect the second tool mounting shaft and the second gear in an independently rotatable manner.

16. The cleaning tool attachment according to claim 15, wherein the housing includes a cleaning liquid inlet configured to feed a cleaning liquid, and a cleaning liquid channel configured to distribute the cleaning liquid fed from the cleaning liquid inlet to the plurality of tool mounting shafts.

17. The cleaning tool attachment according to claim 12, wherein the first tool mounting shaft and the second tool mounting shaft are symmetric with respect to a plane extending along an axial line of the first shaft.

18. The cleaning tool attachment according to claim 17, wherein the housing includes a cleaning liquid inlet configured to feed a cleaning liquid, and a cleaning liquid channel configured to distribute the cleaning liquid fed from the cleaning liquid inlet to the plurality of tool mounting shafts.

19. The cleaning tool attachment according to claim 12, wherein the housing includes a cleaning liquid inlet configured to feed a cleaning liquid, and a cleaning liquid channel configured to distribute the cleaning liquid fed from the cleaning liquid inlet to the plurality of tool mounting shafts.

20. The cleaning tool attachment according to claim 1, wherein the housing includes a cleaning liquid inlet configured to feed a cleaning liquid, and a cleaning liquid channel configured to distribute the cleaning liquid fed from the cleaning liquid inlet to the plurality of tool mounting shafts.

* * * * *